US012613062B2

(12) United States Patent
Park et al.

(10) Patent No.: US 12,613,062 B2
(45) Date of Patent: Apr. 28, 2026

(54) REFRIGERATOR

(71) Applicant: LG ELECTRONICS INC., Seoul (KR)

(72) Inventors: Kyungwook Park, Seoul (KR); Kihwang Kim, Seoul (KR); Jongkwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 261 days.

(21) Appl. No.: 18/102,210

(22) Filed: Jan. 27, 2023

(65) Prior Publication Data

US 2023/0272962 A1 Aug. 31, 2023

(30) Foreign Application Priority Data

Jan. 28, 2022 (KR) ..... 10-2022-0013689

(51) Int. Cl.
*F25D 17/06* (2006.01)
*F25D 23/06* (2006.01)

(52) U.S. Cl.
CPC ..... *F25D 17/065* (2013.01); *F25D 23/061* (2013.01); *F25D 2317/0681* (2013.01)

(58) Field of Classification Search
CPC ..... F25D 17/065; F25D 23/061; F25D 2317/0681; F25D 17/08
See application file for complete search history.

(56) References Cited

U.S. PATENT DOCUMENTS

| | | | | |
|---|---|---|---|---|
| 2018/0163748 | A1* | 6/2018 | Hayamitsu | F04D 29/444 |
| 2019/0128588 | A1* | 5/2019 | Wang | F25D 17/062 |
| 2020/0326116 | A1 | 10/2020 | Hong et al. | |
| 2021/0262718 | A1* | 8/2021 | Burlingham | F25D 17/065 |
| 2021/0262720 | A1* | 8/2021 | Cheng | F25D 17/08 |

FOREIGN PATENT DOCUMENTS

| | | | |
|---|---|---|---|
| KR | 10-1999-0072299 | A | 9/1999 |
| KR | 10-2007-0010547 | A | 1/2007 |
| KR | 10-2020-0121110 | A | 10/2020 |
| KR | 10-2021-0053173 | A | 5/2021 |

* cited by examiner

*Primary Examiner* — David J Teitelbaum
(74) *Attorney, Agent, or Firm* — KED & ASSOCIATES

(57) ABSTRACT

A refrigerator including an evaporator configured to generate cold air; and a grill fan assembly configured to blown the cold air generated by the evaporator to a freezer compartment and an ice-making chamber. The grill fan assembly includes a freezing fan module; an ice-making fan module disposed in a predetermined area of the freezing fan module; a first cold air flow path guide disposed between the freezing fan module and the ice-making fan module; and a second cold air flow path guide disposed between the freezing fan module and the first cold air flow path guide. The first cold air flow path guide and the second cold air flow path guide are spaced apart from an upper wall of the grill fan assembly.

14 Claims, 13 Drawing Sheets

REFRIGERATOR

CROSS-REFERENCE TO RELATED APPLICATION

This application claims priority to and the benefit of Korean Patent Application No. 10-2022-0013689, filed in Korea on Jan. 28, 2022, the disclosure of which is incorporated herein by reference in its entirety.

BACKGROUND

1. Field

The present disclosure relates to a refrigerator, more particularly, a refrigerator that may reduce freezing of a freezing fan module and an ice-making fan module of a grill fan assembly.

2. Background

A refrigerator is a home appliance configured to supply cold air generated by refrigerant circulation to a storage chamber (e.g., a refrigerator compartment or a freezer compartment) to keep various kinds of storage targets fresh for a long time in the storage chamber.

A refrigerator compartment refrigerates the storing targets and the freezer compartment freezes the storing target. Due to this structure, the amount of supplied cold air needs to be adjusted differently so that the refrigerator compartment and the freezer compartment may maintain different temperatures.

In addition to the freezer compartment of the refrigerator, an ice-making chamber may be formed in a door coupled to a front surface of the refrigerator so that a user may discharge ice even without opening the door.

A refrigerant circulating in the order of a compressor, a condenser, an evaporator and a compressor flows into an evaporator, and the liquid refrigerant is vaporized into gaseous refrigerant. During this process, the cold air supplied to a refrigerator compartment, a freezer compartment and an ice-making chamber may be generated by taking heat from the inside of the refrigerator.

Meanwhile, one grill fan assembly including a freezing fan module and an ice-making fan module may be provided. The cold air generated by an evaporator may be blown and supplied to the refrigerator compartment and the ice-making chamber by operating the freezing fan module and the ice-making fan module to blow the cold air In this instance, since the temperatures required for the freezer compartment and the ice-making chamber are different, the amounts of cold air supplied to the freezer compartment and the ice-making chamber will be different.

Temperature sensors may be provided in the freezer compartment and the ice-making chamber, respectively. The freezing fan module and the ice-making fan module may be independently driven to blow cold air to the freezer compartment and the ice-making chamber depending whether preset temperatures are satisfied.

There might be following disadvantages when the freezing fan module and the ice-making fan module are provided in the grill fan assembly for blowing the generated by one evaporator.

The freezing fan module and the ice-making fan module are independently operated. Due to this structure, the ice-making fan module will not operate if the temperature required for the ice-making chamber is satisfied.

If the ice-making fan module is not operated as described above, a negative pressure could be generated in the grill fan assembly and cold air might flow backward to the grill fan assembly through an ice-making chamber cold air supply duct.

The cold air flowing backward through the ice-making chamber cold air supply duct could come from the part with relatively high humidity such as the refrigerator compartment. Because of that, relatively humid cold air might flow into the grill fan assembly.

In this instance, the ice-making fan module is disposed adjacent to the ice-making chamber cold air supply duct so that the cold air flowing back might be conceived on the ice-making chamber.

The cold air conceived on the ice-making chamber module may be frozen by the evaporator so that an ice-making fan of the ice-making fan module might freeze not to operate.

In addition, even when the temperature required for the freezer compartment is satisfied, the freezing fan will not operate.

If the freezing fan module is not operated as described above, a negative pressure could be generated in the grill fan assembly and cold air might flow backward to the grill fan assembly from the freezer compartment.

The cold air flowing backward from the freezer compartment also could have relatively high humidity. Because of that, relatively humid cold air might flow into the grill fan assembly and the humid cold air might freeze inner components of the grill fan assembly.

In addition, when the cold air generated by one evaporator is supplied not only to the freezer compartment and the ice-making chamber but also to the refrigerator compartment, the cold air must be supplied to three or more storage chambers by using one evaporator.

In particular, since the freezer compartment has a much larger space than the ice-making chamber, much more cold air must be supplied to the freezer compartment. Despite this, it is difficult to supply sufficient cold air to the freezer compartment.

In addition, when the ice-making chamber is disposed in the door coupled to the front surface of the refrigerator and the grill fan assembly including the ice-making fan module is disposed in a rear surface of the refrigerator, an ice-making chamber cold air supply duct for facilitate communication between the grill fan assembly and the ice-making chamber to supply cold air is required.

Since the frill fan assembly and the ice-making chamber are distant from each other, the length of the ice-making chamber cold air supply duct increases. To supply cold air to the ice-making chamber after passing through the long duct, the ice-making fan module must strongly blow cold air.

However, a sufficient amount of cold air required for the ice-making chamber could not be supplied by only the cold air blown by the ice-making fan module.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
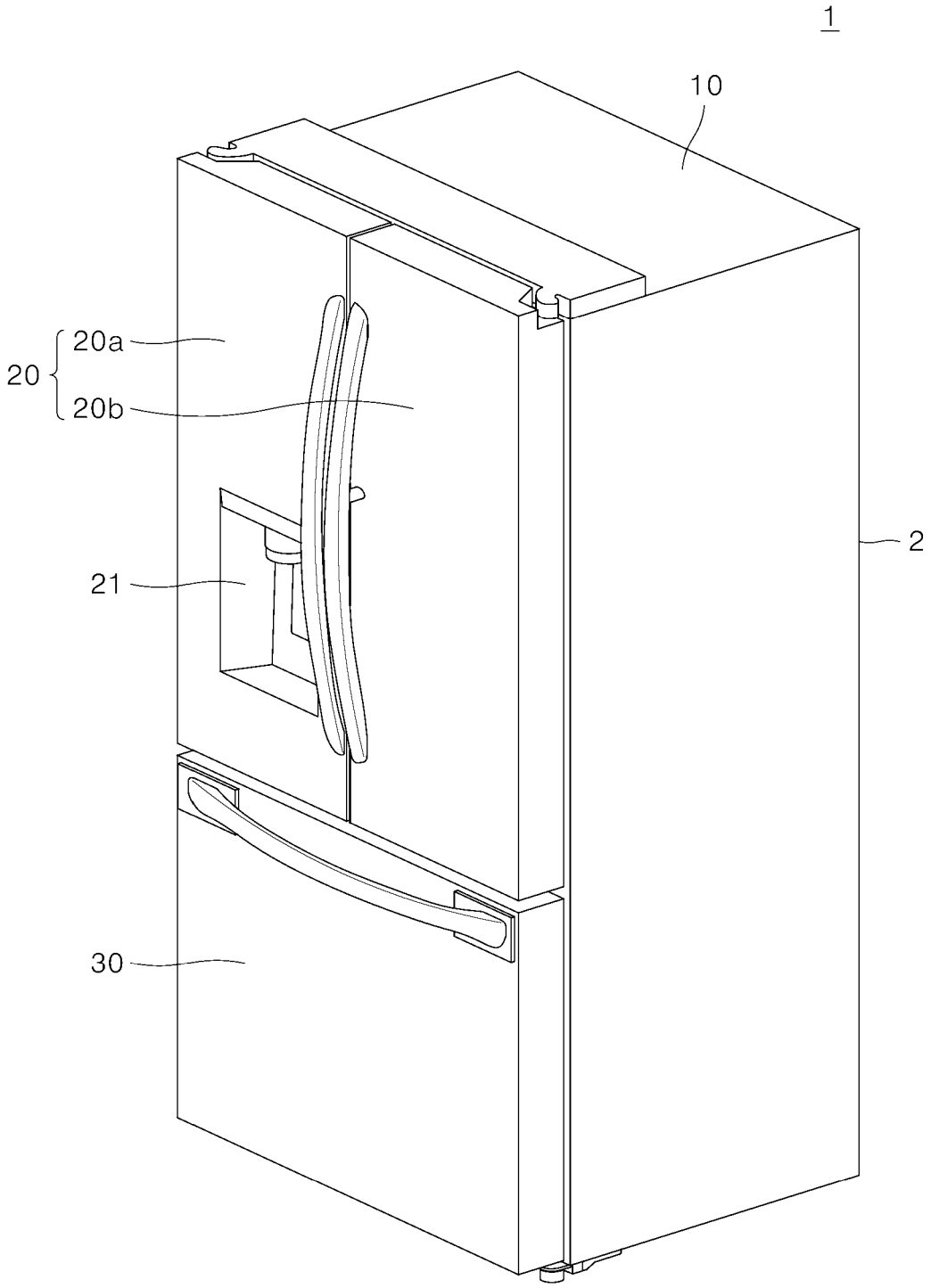
FIG. 1 is a front perspective view showing a state where a door of a refrigerator including an ice-making chamber is closed.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

[Overall structure of Refrigerator]

Figure 2:
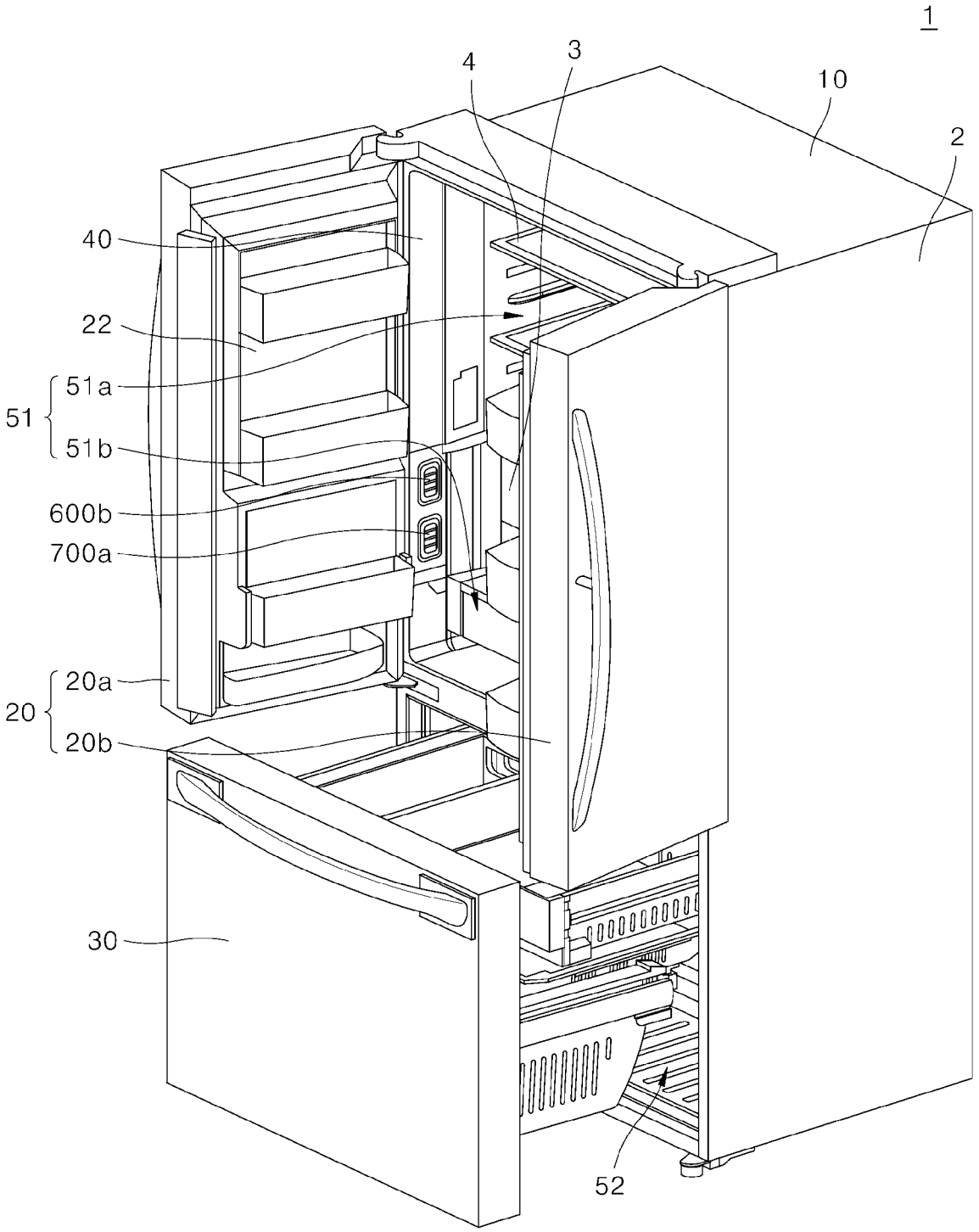
FIG. 2 is a front perspective view showing a state where a door of a refrigerator is open.

FIG. 1 is a front perspective view showing a state where a door of a refrigerator including an ice-making chamber is closed. FIG. 2 is a front perspective view showing a state where a door of a refrigerator is open.

An exterior design of the refrigerator 1 may be defined by a cabinet 1 defining a storage space and a door configured to open and close an open front of the cabinet 2.

The cabinet 2 may include an outer case 10 forming an outer surface of the refrigerator 1 and an inner case 40 forming an inner surface of the outer case 10.

The outer case 10 and the inner case 40 may be spaced a preset distance apart from each other and an insulating material is foamed in the space between them to fill the empty space with the insulating material.

A storage space inside the cabinet 2 may be divided into a plurality of spaces, which are a refrigerator compartment 51 and a freezer compartment 52.

As one embodiment of the present disclosure, the freezer compartment 52 may be mounted in a lower space of the cabinet 2 and the refrigerator compartment 51 may be mounted in an upper space.

A door may be coupled to a front surface of the cabinet 2 to open and close the refrigerator 1.

An upper door 20 may be coupled to a front surface corresponding to the refrigerator compartment 51 and a lower door 30 may be coupled to a front surface corresponding to the freezer compartment 52.

For example, the upper door 20 may be a rotation type configured of a first upper door 20 and a second upper door 20*b* that are rotatable on shafts on both sides of the cabinet 2, respectively.

The lower door 30 may be a drawer type configured to slide inward or outward along a rail.

A dispenser 21 may be disposed in the first upper door 20*a* and configured to discharge water or ice even when the door is not opened.

Referring to FIG. 2, an ice-making chamber 22 may be disposed in the first upper door 20*a* in which the dispenser 21 is provided, and may be configured to make ice.

On an inner surface of the inner case 40 connected to the first upper door 20*a* may be formed an ice-making chamber cold air supply outlet hole 600*b* for supply cold air to the ice-making chamber 22 and an ice-making cold air returning inlet hole 700*a* for returning cold air from the ice-making chamber 22.

The ice-making chamber cold air supply outlet hole 600*b* and the ice-making cold air returning inlet hole 700*a* may be in communication with one surface of the ice-making chamber 22, in a state where the first upper door 20*a* is closed.

The refrigerator compartment 51 may be divided into a first storage chamber 51*a* and a second storage chamber 51*b*.

The second storage chamber 51*b* may be a pantry room that may control the temperature to accommodate a specific storage target such as vegetables or meat.

The first storage chamber 51*a* may refer the other space of the refrigerator compartment 51, except the second storage chamber 51*b*, and may be a main storage space.

For example, the second storage chamber 51*b* may be disposed below the first storage chamber 51*a*, and may be partitioned off as a separate space from the first storage chamber 51*a* by a partitioning member.

A storage drawer 3 may be provided in the second storage chamber 51*b* and configured to slide outward and inward along a rail.

In addition, a storage drawer 3 or a shelf 4 may be provided in the first storage chamber 51*a* to easily keep or preserve fresh storing targets. Separate temperature sensors may be provided in the first storage chamber 51*a* and the second storage chamber 51*b*, respectively, and configured to independently adjust and keep different temperatures.

[Cold air supply system and Connection relation between Components]

Figure 3:
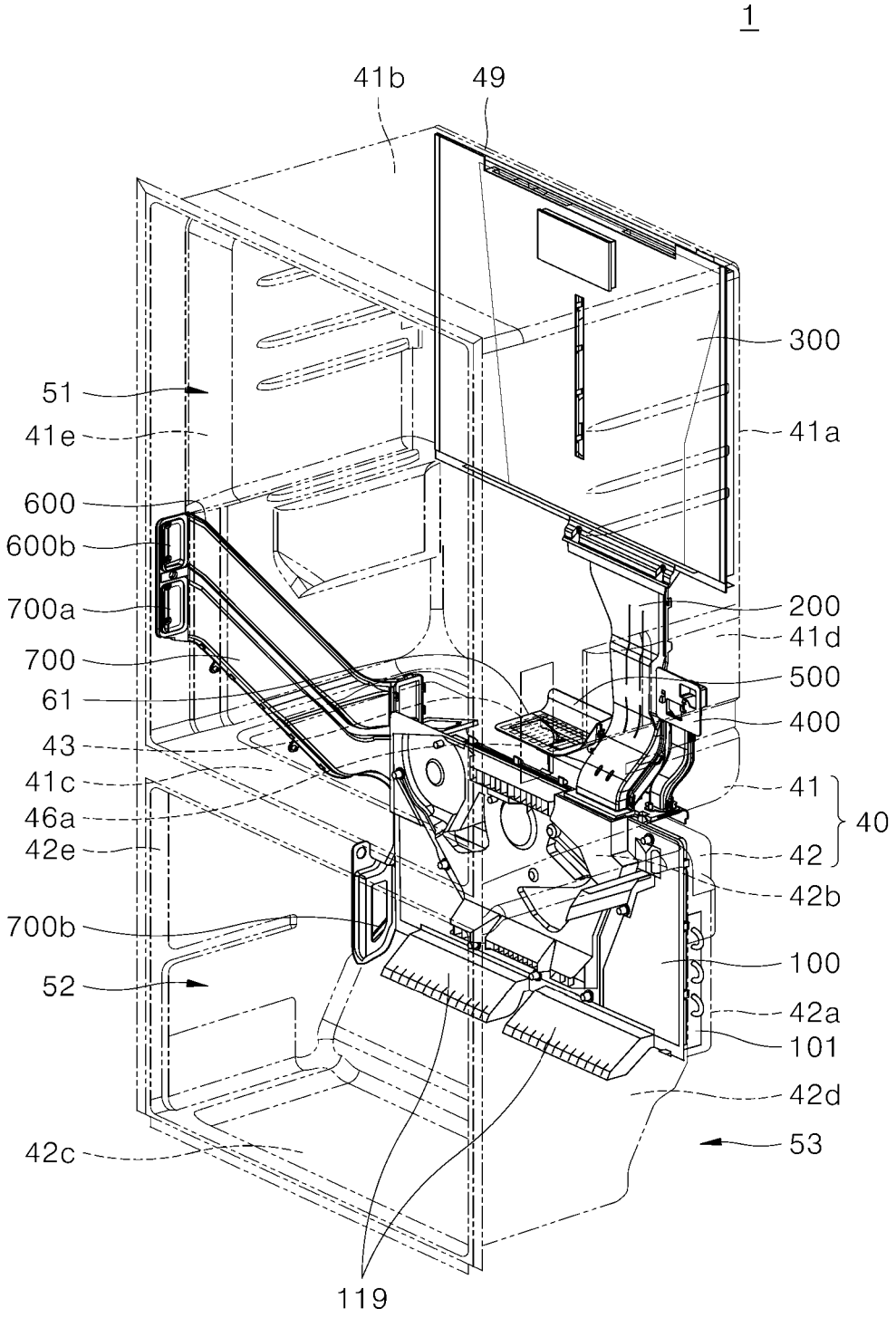
FIGS. 3 and 4 are front and rear perspective views showing a state where an inner case, various ducts and a grill fan assembly are coupled to each other.
Figure 4:
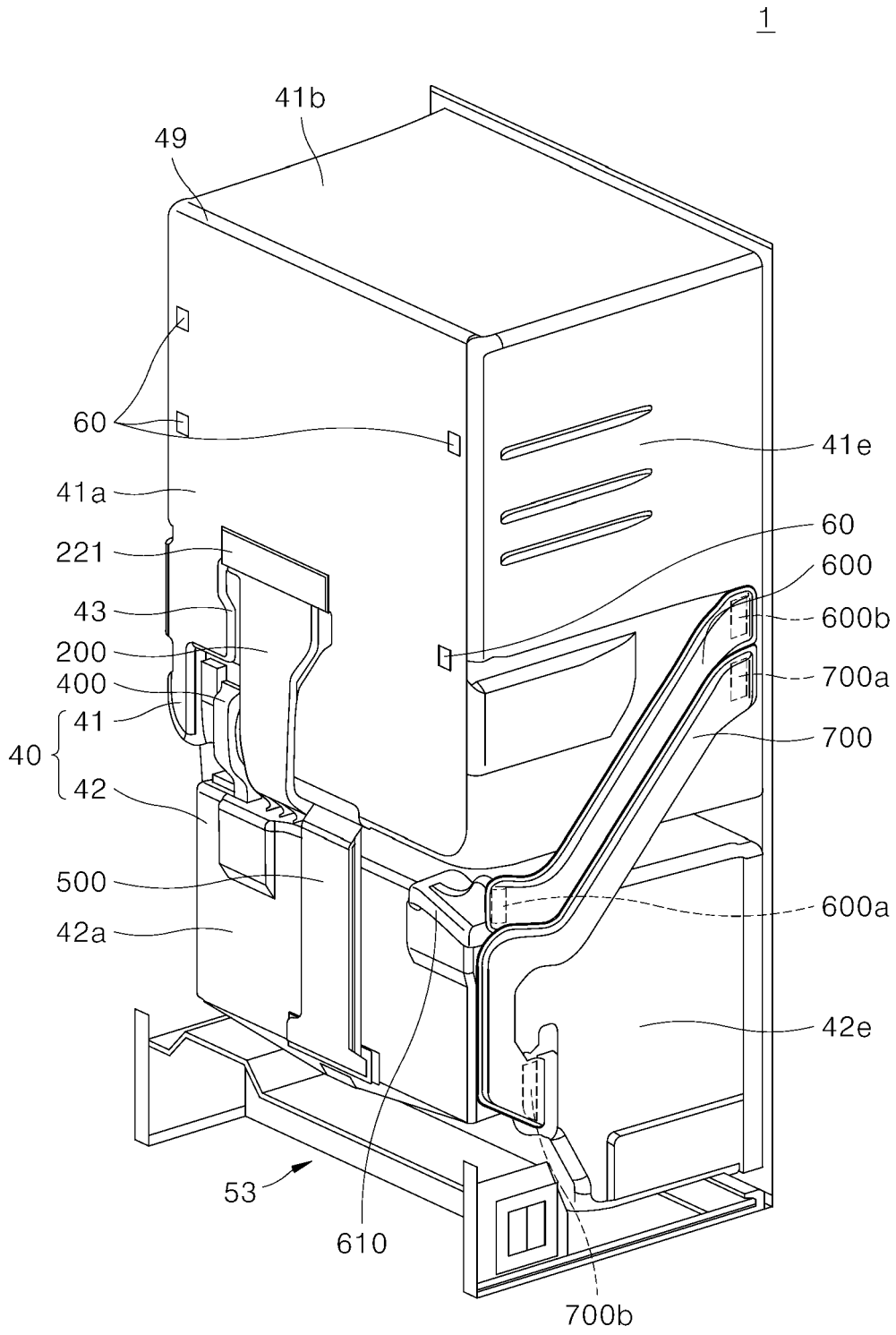
Figure 5:
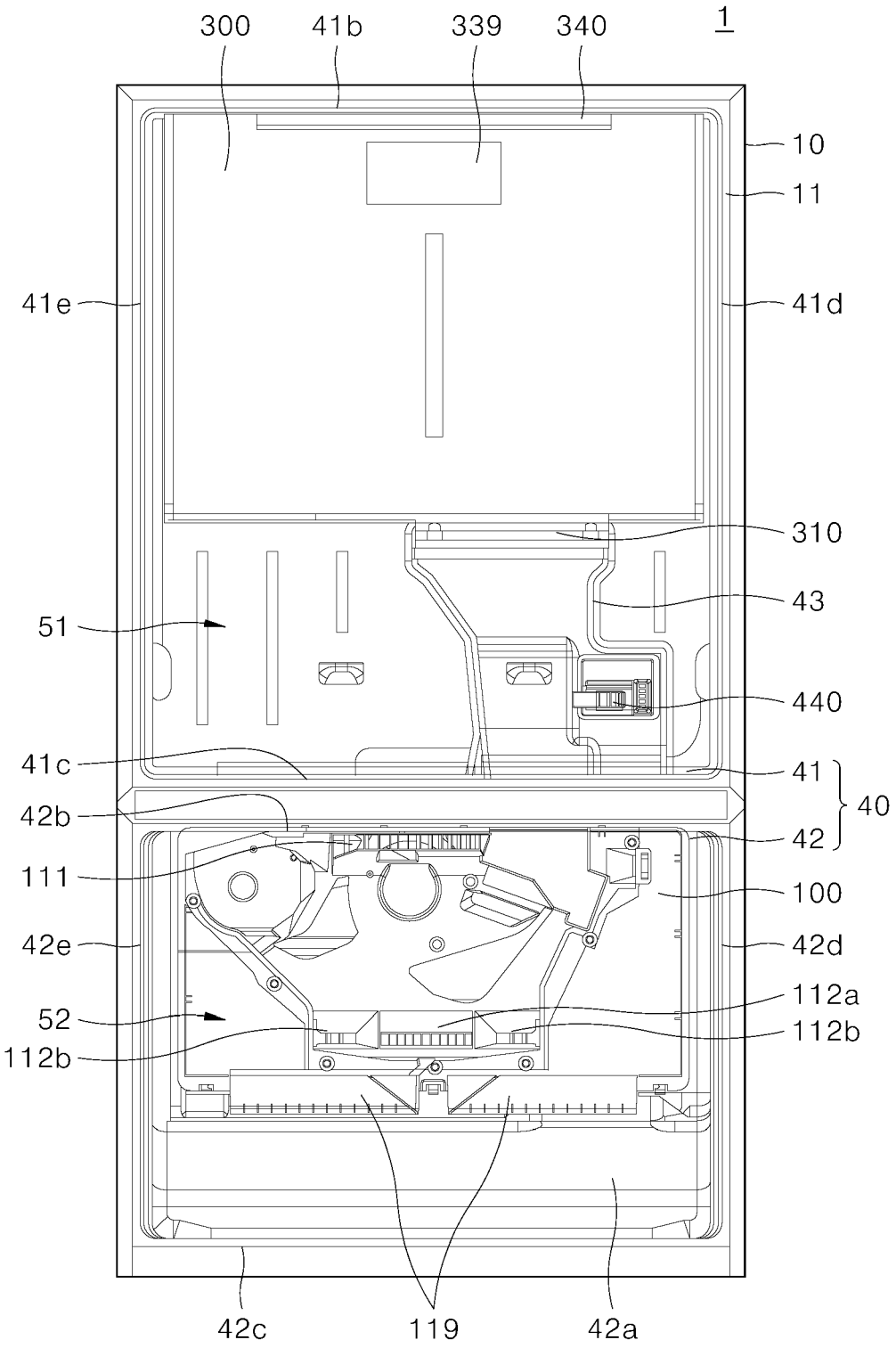
FIG. 5 is a front view of a refrigerator including a grill fan assembly and a refrigerator compartment cold air supply duct.

Hereinafter, referring to FIGS. 3 to 5, a new cold air supply system formed by coupling the inner case, various ducts and a grill fan assembly to each other and the connection relation between them will be described.

The inner case 40 may include a refrigerating case 41 disposed in an upper area and constituting the refrigerator compartment 51, and a freezing case 42 disposed in a lower area and constituting the freezer compartment 52.

The refrigerating case 41 may have a box shape having an open front surface, and a rear surface 41*a*, an upper surface 41*b*, a lower surface 41*c*, a lateral surface 41*d* and the other lateral surface 42*e* that are closed.

The freezing case 42 may also have a box shape having an open front surface, and a rear surface 42*a*, an upper surface 42*b*, a lower surface 42*c*, a lateral surface 42*d* and the other lateral surface 42*e* that are closed.

The cold air generated by one evaporator 101 may be supplied both of the refrigerator compartment 51 and the freezer compartment 52.

The evaporator 101 for generating cold air may be disposed inside the freezer compartment 52, specifically, on a rear surface 42*a* of the freezing case 42.

The evaporator 101 may be disposed in an upper area of a mechanical chamber 53.

A grill fan assembly 100 configured to blow the cold air generated by the evaporator 101 to the refrigerator compartment 51 and the freezer compartment 52 may be disposed on a front surface of the evaporator 101.

To blow cold air to a refrigerator compartment cold air supply duct 300, a connection duct 200 may be further provided between the grill fan assembly 100 and the refrigerator compartment cold air supply duct 300.

One end of the connection duct 200 may be connected to the grill fan assembly 100 and the other end of the connection duct 200, so that the cold air blown from the grill fan assembly 100 may be guided to the refrigerator compartment cold air supply duct 300.

Specifically, the other end of the connection duct 200 may be coupled to a refrigerator compartment cold air supply connecting portion 310 extended downward from the refrigerator compartment cold air supply duct 300.

A rear extended portion 221 may be provided on an upper surface of the connection duct 200. The rear extended portion 221 may be extended from a rear end of the upper surface of the connection duct 200 in a vertical direction.

The rear extended portion 221 may be configured to support the rear surface 41*a* of the refrigerating case.

The refrigerator compartment cold air supply duct 300 may be disposed on an inner surface the refrigerating case 41, and the connection duct 200 may be disposed on an outer surface of the refrigerating case 41. The refrigerator compartment cold air supply duct 300 and the connection duct 200 may be in communication at a rear surface 41*a* of the refrigerating case.

A duct inserting groove 49 may be provided along an area in which the upper surface 41*b* meets the rear surface 41*a* of the refrigerating case.

The duct inserting groove 49 may be formed in a protrusion shape protruding upward, viewed above the upper surface 41*b* of the refrigerating case, or a concave shape recessed upward, viewed below the upper surface 41*b* of the refrigerating case.

Some of an upper region of the refrigerator compartment cold air supply duct 300 may be inserted in the duct inserting groove 49 to be strongly secured by face-to-face contact.

A refrigerator compartment cold air main outlet hole 340 for discharging the cold air generated by the evaporator 101 disposed in the freezer compartment toward the front surface of the refrigerator compartment 51 may be formed in the upper region of the refrigerator compartment cold air supply duct 300/

A refrigerator compartment cold air auxiliary outlet guide 339 configured to discharge cold air to the refrigerator compartment 51 may be formed below the cold air main outlet hole 340 to circulate the cold air in the entire area of the refrigerator compartment 51.

The refrigerator compartment cold air supply duct 300 may be secured to the rear surface 41*a* of the refrigerating case through a plurality of coupling through-holes 40 formed in the rear surface 41*a* of the refrigerating case, that corresponds to the area where the refrigerator compartment cold air supply duct 300 is disposed, by using a separate coupling member.

An insulating material 11 may be foamed in a space between the inner case 40 and the outer case 10 to fill in the space.

The connection duct 200 may be embedded in the space between the inner case 40 and the outer case 10 by passing through the space foamed and filled with the insulating material 11.

A rear projected portion 43 protruding to the inside of the refrigerating case 41 may be provided on a rear surface 41*a* of the refrigerating case so that at least predetermined area of the connection duct 200 may be inserted from the outside of the refrigerating case 41.

Since the connection duct 200 is disposed on a rear surface of the rear projected portion 43, the connection duct 200 may be disposed on an outer surface not an inner surface of the refrigerating case 41.

Accordingly, an additional area protruding toward the inside of the refrigerating case 41 except the rear projected portion 43 may be reduced up to the height of the rear projected portion 43 in which the connection duct 200 is inserted, so that the inner volume of the refrigerating case 41 may be increased by that much.

The refrigerator 1 according to the present disclosure may include a refrigerator compartment cold air returning duct configured to return and supply the cold air of the refrigerator compartment to the evaporator 101.

The refrigerator compartment cold air returning duct 500 may have one end connected to the freezer compartment 52 and the other end connected to the refrigerator compartment 51. The both ends of the refrigerator compartment cold air returning duct 500 may overlap with each other in a vertical direction.

One end of the refrigerator compartment cold air returning duct 500 may be configured to communicate with the freezer compartment 52 through a refrigerator compartment returning communication outlet hole 46*b*.

The refrigerator compartment cold air returning duct 500 may pass through the rear surface of the evaporator 101.

The refrigerator compartment returning duct 500 may be configured to return the cold air circulating after supplied to the refrigerator compartment 51 to the freezer compartment 52.

The refrigerator compartment 51 may be divided into a first storage chamber 51*a* and a second storage chamber 51*b*.

A second storage chamber cold air supply duct 400 may be configured to supply cold air to the second storage chamber 51*b*, and the second storage cold air supply duct 400 may be disposed on the outer surface of the refrigerating case 41.

The heat insulating material 11 may be foamed and filled in the space between the inner case 40 and the outer case 10.

The second storage chamber cold air supply duct 400 may be disposed to pass through the space foamed and filled with the insulating material 11, to be embedded in the space between the inner case 40 and the outer case 10.

the rear projected portion 43 projected inward of the refrigerating case 41 may be provided on the rear surface 41*a* of the refrigerating case in order to receive at least predetermined area of the connection duct 200 from the outside o the refrigerating case 41.

In this instance, the rear projected portion 43 may be formed in a shape capable of receiving the at least predetermined area of the second storage chamber cold air supply duct 400 in addition to the shape capable of receiving the connection duct 200.

The connection duct 200 and the second storage chamber cold air supply duct 400 may be disposed adjacent to each other.

A second storage chamber cold air outlet cover 440 may be provided on a front surface of the other end of the second storage chamber cold air supply duct 400 connected to the second storage chamber 51*b*.

The second storage chamber cold air outlet cover 440 may be disposed inside the refrigerating case 41.

The refrigerator 1 according to the present disclosure may include the ice-making chamber 22 provided in the upper door 20 configured to open and the close the refrigerator compartment 51.

The cold air generated by the evaporator 101 may be supplied to the ice-making chamber 22 through an ice-making chamber cold air supply duct 600.

An ice-making chamber cold air supply inlet hole 600*a* may be formed in one end of the ice-making chamber cold air supply duct 600 to be in communication with the grill fan assembly 100 through an ice-making chamber cold air supply communication inlet hole 47*a* of the freezing case 42.

In this instance, an ice-making cold air guide duct 610 may be disposed between the ice-making chamber cold air supply duct 600 and the grill fan assembly 100 to facilitate communication between the cold air supply duct 600 and the frill fan assembly 100.

The ice-making chamber cold air supply duct 610 may be configured to switch a direction of the cold air discharged from the frill fan assembly 100.

The other end of the ice-making chamber cold air supply duct 600 may be in communication with the ice-making chamber 22 through the ice-making chamber cold air supply communication outlet hole 600*b* formed on the other surface 41*e* of the refrigerating case.

The cold air circulated in the ice-making chamber 22 may return to the freezer compartment 52 through an ice-making chamber cold air returning duct 700.

An ice-making chamber cold air returning outlet hole 700*b* may be formed in one end of the ice-making chamber cold air returning duct 700, to discharge the cold air returning from the ice-making chamber 22 to the freezer compartment 52 by communication with the other lateral surface 42*e* of the freezing case.

The cold air discharged to the freezer compartment 52 after returning from the ice-making chamber 22 may return again to a freezer compartment cold air returning guide 119 disposed on a lower surface of the grill fan assembly 100.

An ice-making returning inlet hole 700*a* may be formed in the other end of the ice-making chamber cold air returning duct 700 to communicate with one lateral surface of the ice-making chamber 22 in a state where the first upper door 20*a* is closed.

[Grill fan assembly]

Hereinafter, referring to FIGS. 6 to 10, the grill fan assembly 100 will be described in detail.

The grill fan assembly 100 according to the present disclosure may include a shroud 120 and a grill fan 110.

The shroud 120 may define a rear exterior design of the grill fan assembly 100 and the grill fan 110 may define a front exterior design of the grill assembly 100.

The grill fan 110 may be disposed toward the front surface of the freezer compartment 52, and the shroud 120 may be disposed toward the rear surface 42*a* of the freezing case, that is, the evaporator 101 provided on the rear wall of the freezing case.

The shroud 120 may include a first inlet hole 121*a* and a second inlet hole 121*b*.

The cold air heat-exchanged while passing through the evaporator 101 disposed behind the shroud 120 may flow into the space formed between the first inlet hole 121*a* and the second inlet hole 121*b*.

A freezing fan module 160 is disposed on a front surface of the first inlet hole 121*a* and an ice-making fan 170 may be disposed on a front surface of the second inlet hole 121*b*.

The first inlet hole 121*a* may be provided in an upper center region of the grill fan assembly 100 and the second inlet hole 121*b* may be provided in one side region of the grill fan assembly 100 with respect to the first inlet hole 121*a*.

Since the ice-making fan module 170 is disposed the second inlet hole 121*b* to supply cold air to the ice-making chamber 22, the second inlet hole 121*b* may be disposed adjacent to the other lateral surface 42*e* of the freezing case where the ice-making chamber cold air supply duct 600 is provided.

A flow path opening/closing module surface seating portion 122*a* and a second flow path opening/closing module seating portion 112*b* may be formed on the other lateral surface rather than one lateral surface on which the second inlet hole 121*b* is formed with respect to the first inlet hole 121*a*.

The first flow path opening/closing module surface seating portion 122*a* and the second flow path opening/closing module seating portion 122*b* may be formed in a shape projected toward the rear surface of the shroud 120.

The first flow path opening/closing module surface seating portion 122*a* and the second flow path opening/closing module seating portion 122*b* may be disposed in order in a direction getting farther from the first inlet hole 121.

Accordingly, the first flow path opening/closing module surface seating portion 122*a* may be disposed between the first inlet hole 121*a* and the second flow path opening/closing module seating portion 122*b*.

The second flow path opening/closing may have a shape projected more toward the rear surface of the shroud 120 than the first flow path opening/closing module surface seating portion 122*a*.

The shroud 120 may primarily have a step in an area from the first inlet hole 121*a* to the first flow path opening/closing module surface seating portion 122*a*, and may secondarily have a step in an area from the first flow path opening/closing module surface seating portion 122*a* to the second flow path opening/closing module seating portion 122*b*.

Accordingly, steps may be formed from the first inlet hole 121*a* to the first flow path opening/closing module surface seating portion 122*a* and the second flow path opening/closing module seating portion 122*b*.

The grail fan 110 disposed on the front surface of the shroud 120 may be coupled to the shroud 120 to accommodate an ice-making fan module 170, the freezing fan module 160 and the flow path opening/closing module 130.

A grill fan upper region outlet hole 111 may be formed in an upper center region of the grill fan 110 and configured to discharge the cold air blown by the freezing fan module 160 toward an upper front surface of the freezer compartment 52.

In this instance, some of the cold air blown by the ice-making fan module 170 may be discharged to the freezer compartment 52 through the grill fan upper region outlet hole 111.

A grill fan lower region outlet hole 112*a* and 112*b* may be formed in a lower center region of the grill fan 110 to discharge the cold air blown by the freezing fan module 160 toward a lower front surface of the freezer compartment 52.

The grill fan lower region outlet hole 112 may be provided with a first grill fan lower region outlet hole 112*a* and a pair of second grill fan lower region outlet holes 112*b* disposed on both lateral surfaces with respect to the first grill fan lower region outlet hole 112*a*.

The second grill fan lower region outlet hole 112*b* may guide the cold air discharged to the freezer compartment 52 to flow to the both lateral surfaces to uniformly circulate the overall region of the freezer compartment 52.

A pair of freezer compartment cold air returning guides 119 may be formed below the grill fan lower region outlet holes 112*a* and 112*b* to guide the returning cold air.

The cold air having circulated the ice-making chamber 22 and the cold air having circulated the freezer compartment 52 may return to the freezer compartment cold air returning guide 119 provided in the lower region of the freezer compartment 52 to be supplied to the evaporator 101.

A second flow path opening/closing module opposite surface seating portion 113 facing the area of the shroud 120 where the first flow path opening/closing module surface seating portion 122*a* and the second flow path opening/closing module seating portion 122*b* are disposed may be formed in one lateral surface of the grill fan upper region outlet hole 111 of the grill fan 110.

The first flow path opening/closing module opposite surface seating portion 113 may have a shape projected toward the front surface of the grill fan 110.

The grill fan 110 may have a step in an area from the grill fan upper region outlet hole 111 to the first flow path opening/closing module opposite surface seating portion 113.

Accordingly, one surface of the flow path opening/closing module 130 may be seated on the first flow path opening/closing module opposite surface seating portion 113, and the other surface thereof may be seated on the first flow path opening/closing module surface seating portion 122*a* and the second flow path opening/closing module seating portion 122*b*, to be secured to the grill fan assembly 100.

The flow path opening/closing module 130 may include a flow path opening/closing damper 140 and 150 configured to selectively cut off the cold air supplied to the refrigerator compartment 51.

The refrigerator compartment 51 may include a first storage chamber 51*a* and a second storage chamber 51*b* that are preset to have different temperatures, respectively.

In this instance, the flow path opening/closing module 130 may include a first flow path opening/closing damper 140 for selectively cutting off the cold air supplied to the first storage chamber 51*a* and a second flow path opening/closing damper 150 for selectively cutting off the cold air supplied to the second storage chamber 51*b*.

The first chamber flow path opening/closing damper 140 and the second flow path opening/closing damper 150 may be seated on the flow path opening/closing module seating portion 122*a* and 122*b*, in a state of being covered by a damper cover 131.

The damper cover 131 may be formed of an insulating material such as Styrofoam, and the material is not limited thereto.

The damper cover 131 may be formed by coupling a first damper cover 131*a*, a second damper cover 131*b* and a third damper cover 131*c* to each other.

The first flow path opening/closing damper 140 may be disposed between the first damper cover 131*a* and the second damper cover 131*b*, and the second flow path opening/closing damper 150 may be disposed between the second damper 131*b* and the third damper 131*c*.

The second flow path opening/closing damper 150 may be formed in a relatively smaller size than the first flow path opening/closing damper 140.

The third damper cover 131*c* covering only the second flow path opening/closing damper 150 may be formed in a relatively smaller size than the first damper cover 131*a* and the second damper cover 131*b*.

A first cold air outlet 132*a* may be formed on an upper surface of the damper cover 131 covering the first flow path opening/closing damper 140 to be in communication with the connection duct 200 to supply cold air.

A second cold air outlet 132*b* may be formed on an upper surface of the damper cover 131 covering the second flow path opening/closing damper 150 to be in communication with the second storage chamber cold air supply 400 to supply cold air.

A lower region of the damper cover 131 may be open to supply cold air to the first flow path opening/closing damper 140 and the second flow path opening/closing damper 150.

Accordingly, the damper cover 131 may be configured to cover the first flow path opening/closing damper 140 and the second flow path opening/closing damper 150 except the first cold air outlet hole 132*a* and the second cold air outlet hole 132*b* formed on the upper surface and the open space of the lower region.

According to the present disclosure, since the first flow path opening/closing damper 140 and the second flow path opening/closing damper 150 are disposed in the grill fan assembly 100 of the freezer compartment 52, there might be a problem of in that the dampers 140 and 150 disposed adjacent to the evaporator 101 are frozen to cause a malfunction.

Accordingly, the structure of covering the first flow path opening/closing damper 140 and the second flow path opening/closing damper 150 with the damper cover formed of the insulating material may reduce the problem of the frost caused by the evaporator 101.

[Cold air flow path system]

Hereinafter, referring to FIGS. 8 to 10, the cold air flow path system of the grill fan assembly according to the present disclosure will be described in detail.

Figure 8:
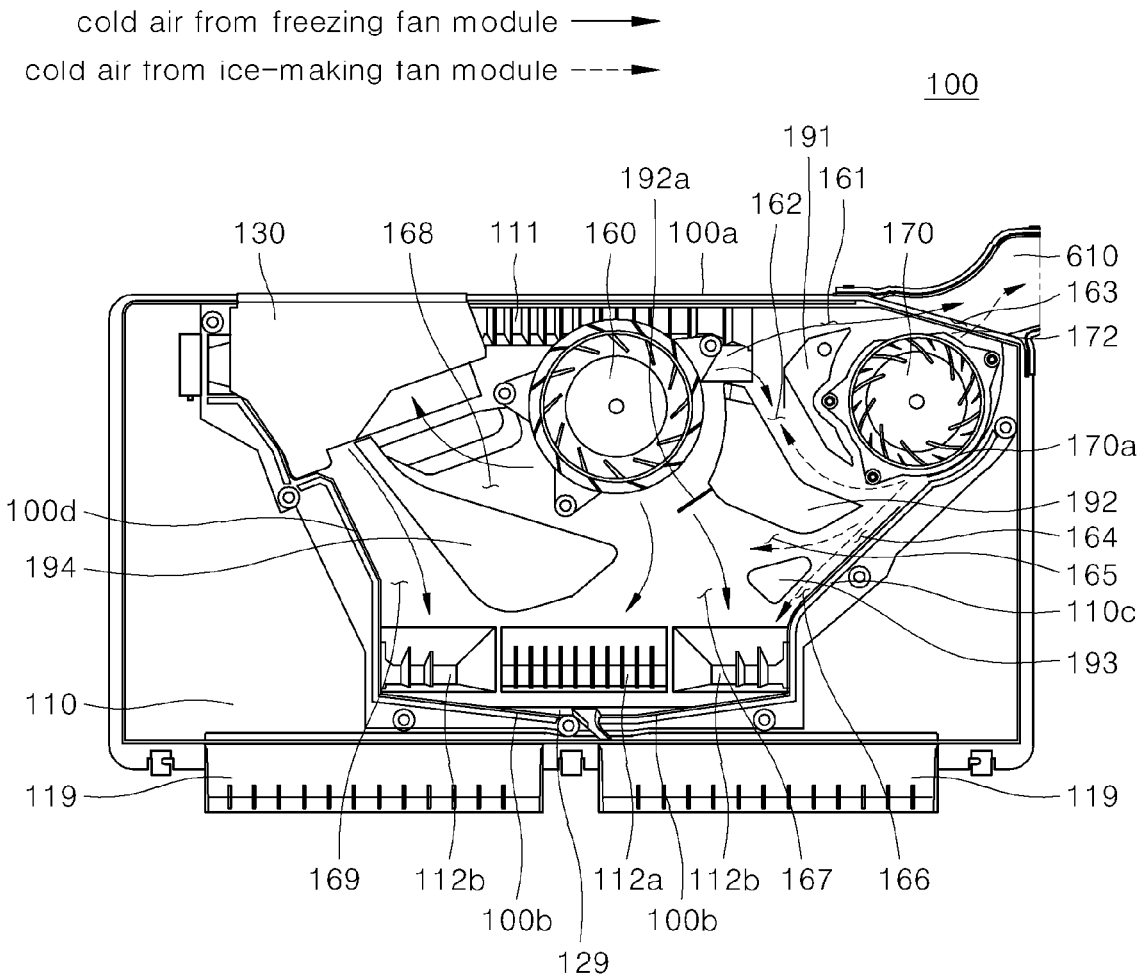
FIG. 8 is a rear view of a grill fan, showing a cold air flow path when a freezing fan module and an ice-making fan module are operated at the same time.

FIG. 8 is a rear view of a grill fan, showing a cold air flow path when a freezing fan module and an ice-making fan module are operated at the same time.

Figure 9:
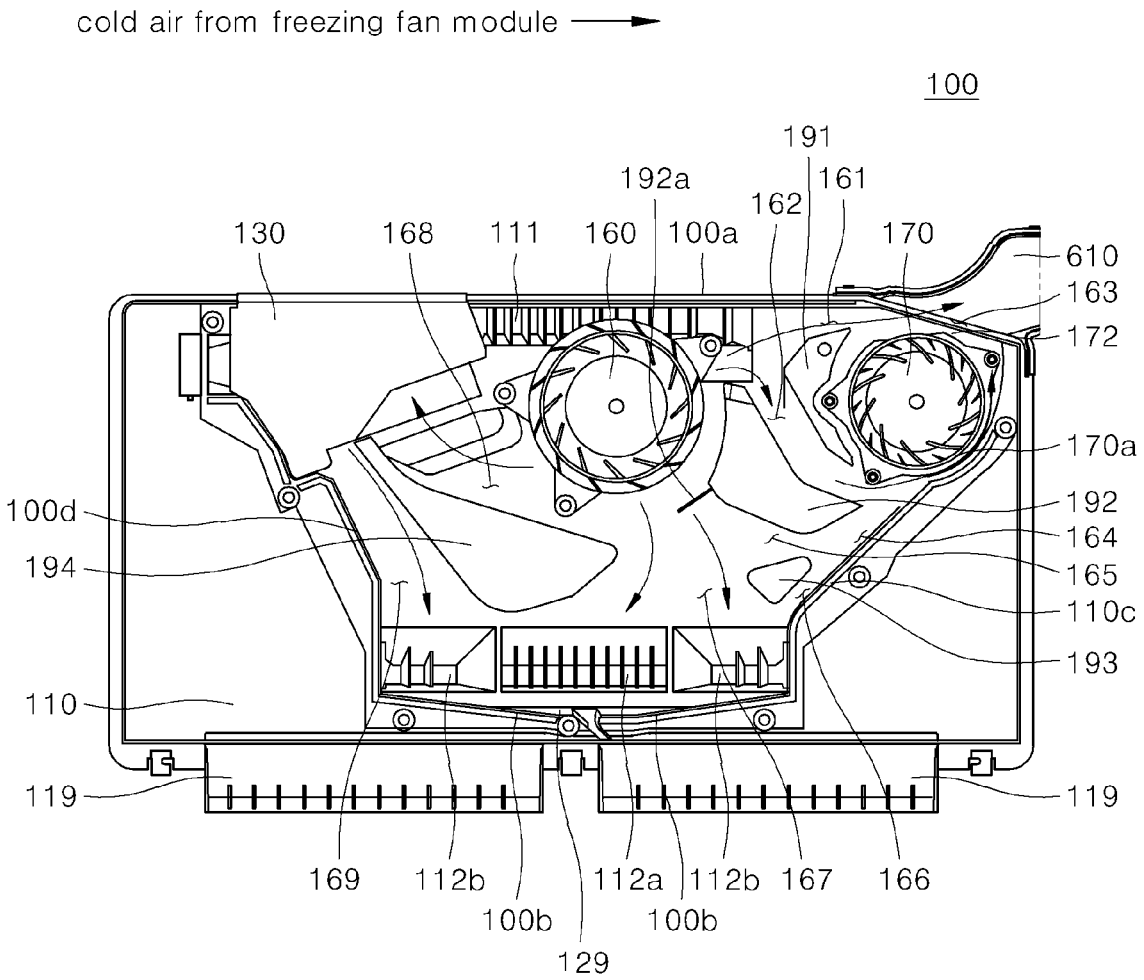
FIG. 9 is a rear view of a grill fan, showing a cold air flow path when an ice-making fan is not operated.

FIG. 9 is a rear view of a grill fan, showing a cold air flow path when an ice-making fan is not operated.

Figure 10:
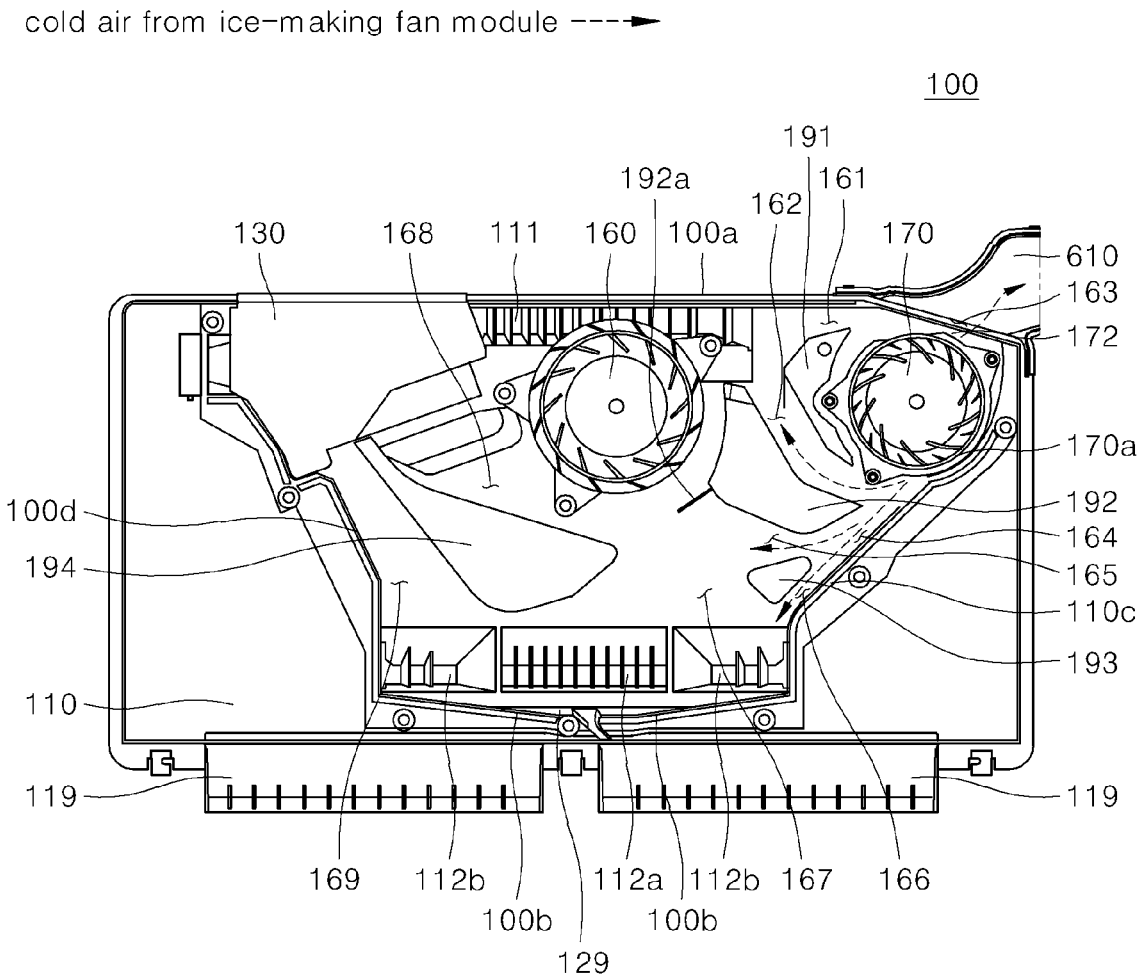
FIG. 10 is a rear view of a grill fan, showing a cold air flow path when a freezing fan module is not operated while an ice-making fan module is operated.

FIG. 10 is a rear view of a grill fan, showing a cold air flow path when a freezing fan module is not operated while an ice-making fan module is operated.

Figure 6A:
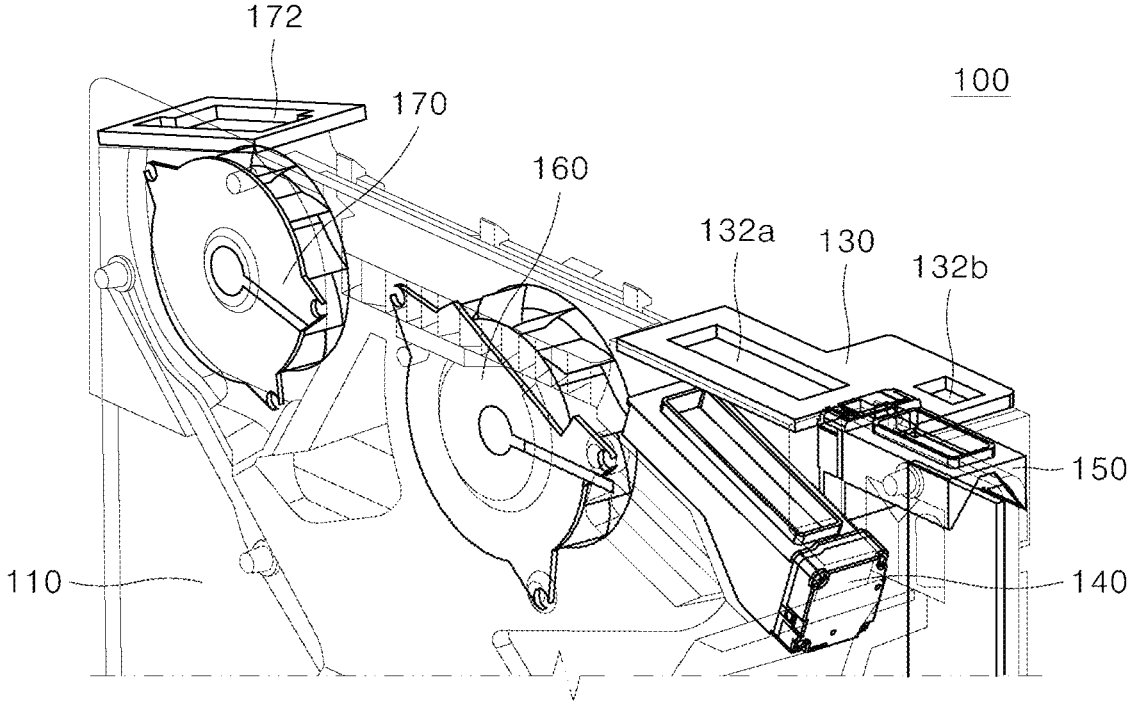
FIG. 6*a* is a perspective view showing an upper region of a grill fan assembly.
Figure 6B:
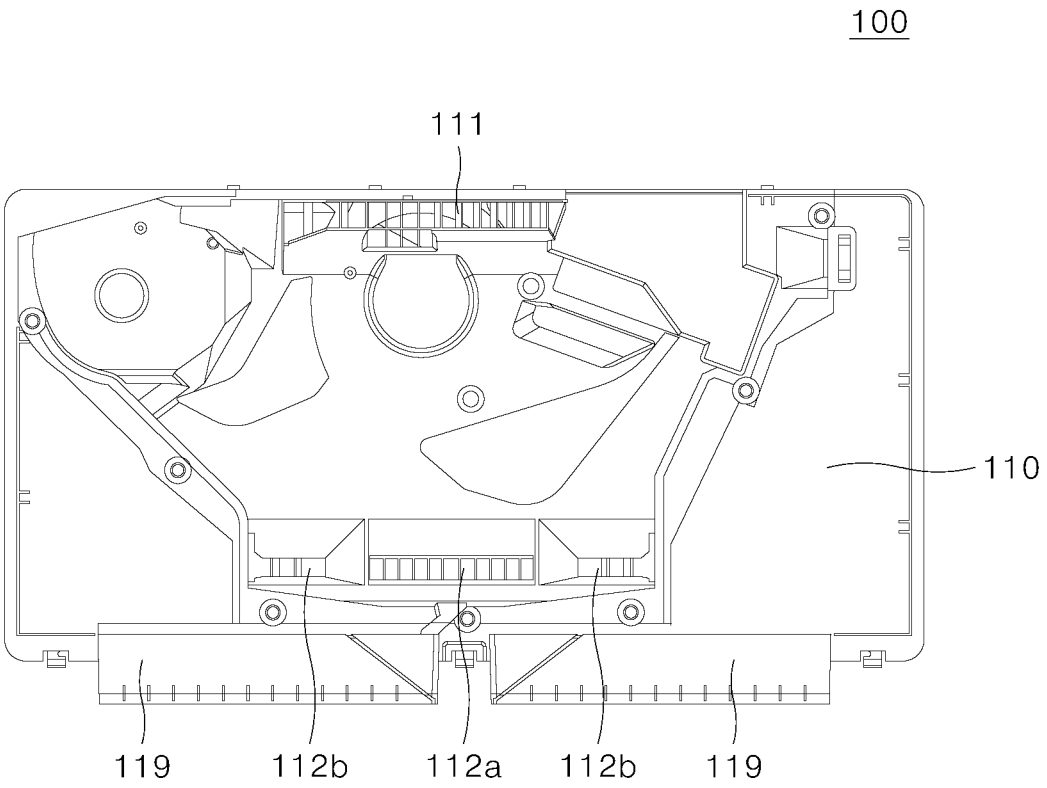
FIG. 6*b* is a front view of a grill fan assembly.
Figure 6C:
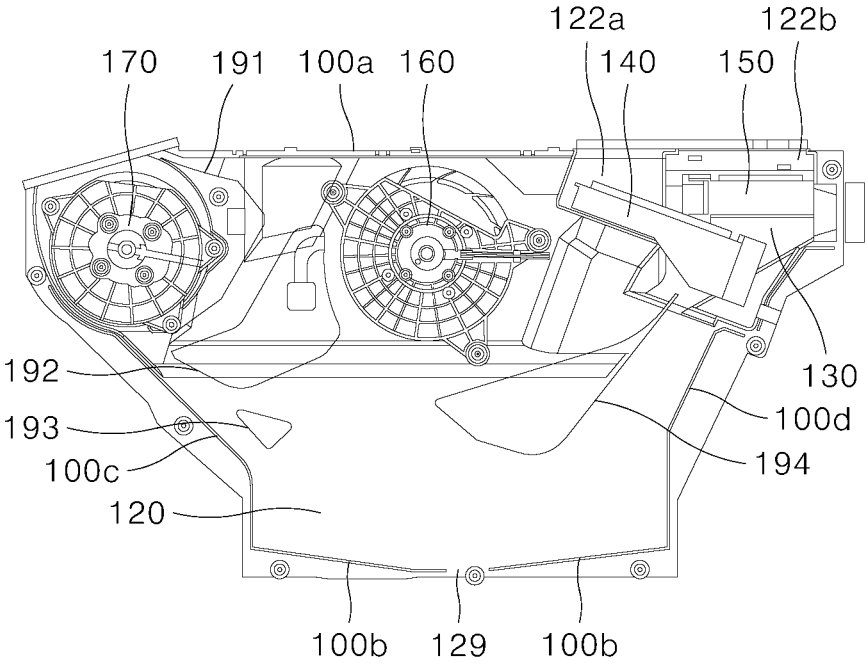
FIG. 6*c* is a front view of a grill fan assembly after omitting a grill fan.
Figure 6D:
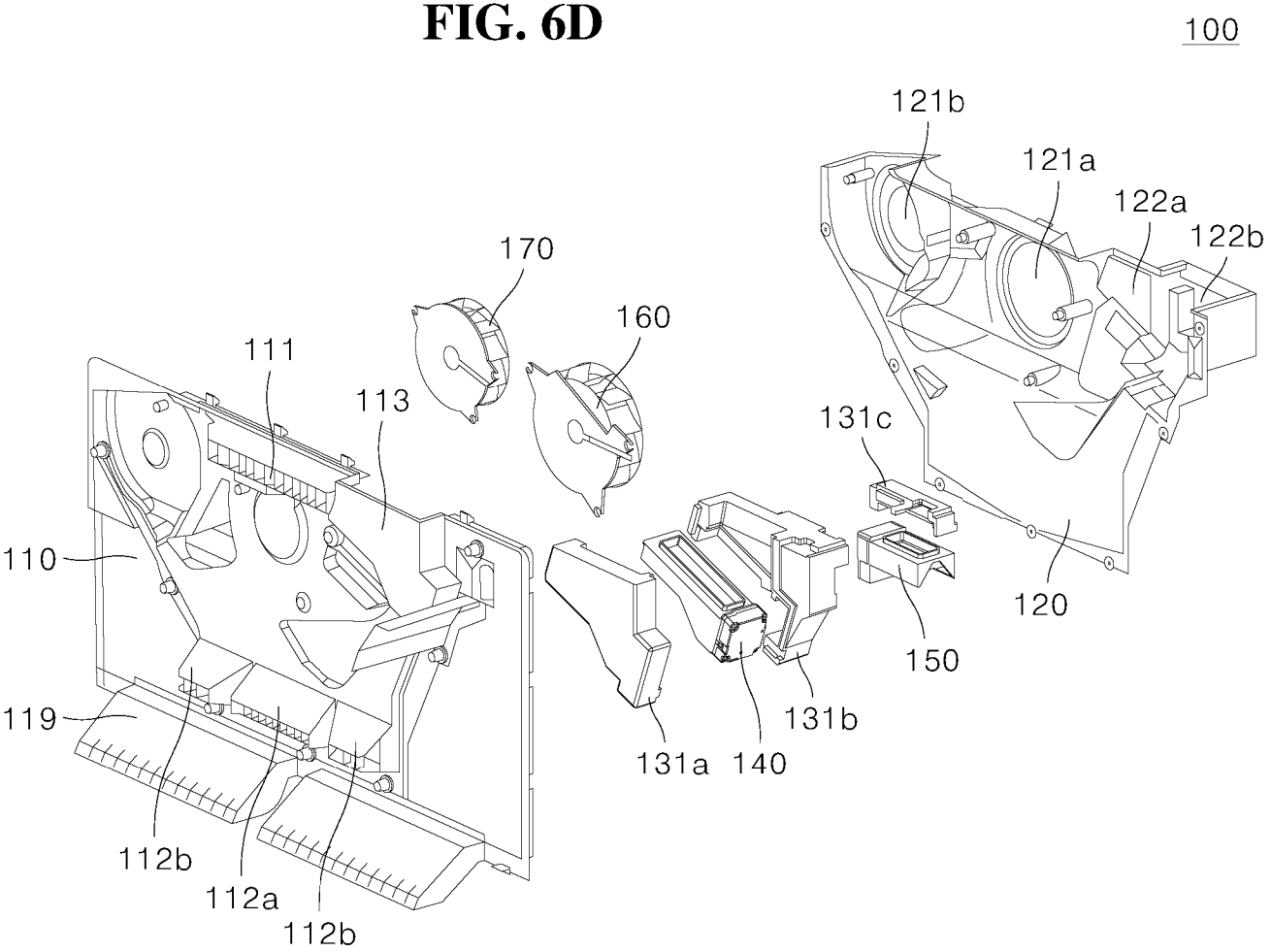
FIG. 6*d* is an exploded perspective view of a grill fan assembly.
Figure 7:
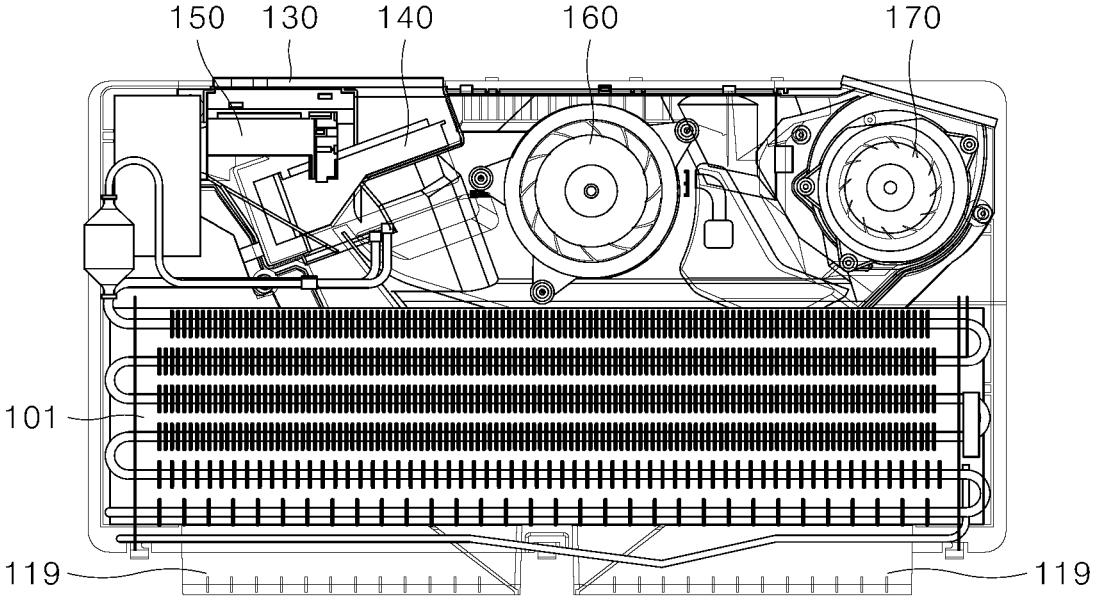
FIG. 7 is a rear view showing that an evaporator is disposed on a rear surface of a grill fan assembly.

Before starting description, FIG. 6*c* is a front view showing a state where the ice-making fan 170, the freezing fan module 160 and the flow path opening/closing module 130 are disposed in the shroud 120 according to the present disclosure.

FIGS. 8 to 10 are rear views showing a state where the ice-making fan module 160 170, the freezing fan module 160 and the flow path opening/closing module 130 are disposed in the grill fan 110.

As described above, the grill fan assembly 100 may be formed by coupling the shroud 120 and the grill fan 110 to each other.

Accordingly, when coupled to the shroud 120, the grill fan 110 may be disposed in opposite to the ice-making fan module 170, the freezing fan module 160 and the flow path opening/closing module 130, which are disposed in the shroud 120.

An upper lateral wall 100*a*, a lower wall 100*b*, a lateral wall 100*c* the other lateral wall 100*d*, cold air flow path guides 191, 192, 193 and 194, and cold air paths 161, 162, 163, 164, 165, 166, 167, 168 and 169 may be formed in the grill fan 110 and/or the shroud 120.

Similarly, the upper lateral wall 100*a*, the lower wall 100*b*, the lateral wall 100*c*, the other lateral wall 100*d*, the cold air flow path guides 191, 192, 193 and 194, and cold air paths 161, 162, 163, 164, 165, 166, 167, 168 and 169, which are formed in the grill fan 110 and the shroud 120, may be disposed in opposite to each other when the grill fan 110 and the shroud 120 are coupled to each other.

Hereinafter, referring to FIGS. 8 to 10, an embodiment that the above-noted components are formed in the grill fan 110 is described but the present disclosure is not limited thereto. The present disclosure will be described in the same way in case the above-noted components are formed in the shroud 120.

An outer wall may be formed on the rear surface of the grill fan 110 and configured to surround the flow path opening/closing module 130, the freezing fan module 160 and the ice-making fan module 170 so that an opening may be formed in some area of the rear surface.

The outer wall may include an upper wall 100*a*, a lower wall 100*b*, a lateral wall 100*c* and the other lateral wall 100*d*.

The upper wall 100*a* may be disposed above the flow path opening/closing module 130, the freezing fan module 160 and the ice-making fan module 170, and may have open portions for an outlet hole for supplying cold air to the refrigerator compartment 51 and an outlet hole for supplying cold air to the ice-making chamber 22.

A grill fan upper region outlet hole 111 may be disposed in a lower area of the upper wall 100 to supply cold air to the upper region of the freezer compartment 52.

The grill fan upper region outlet hole 111 may be disposed in a center region of the grill fan assembly 100 to overlap with an upper area of the freezer fan module 160.

The lateral wall 100*c* may be provided on a lateral surface on which the ice-making fan module 170 is disposed.

Some area of the lateral wall 100*c* may be in contact with one lateral surface of the ice-making fan module 170.

The lateral wall 100*c* may have an inclined surface that gets closer to a central direction from a top to a bottom.

The other lateral surface 100*d* may face the lateral wall 100*c*, and may be provided on a lateral surface on which the flow path opening/closing module 130 is provided.

Some area of the other lateral wall 100*d* may be in contact with one lateral surface of the flow path opening/closing module 130.

The other lateral surface 100*d* may have an inclined surface that gets closer to a central direction from a top to a bottom.

The lower wall 100*b* may be disposed below the frill fan 110.

A grill fan lower region outlet hole 112*a* and 112*b* may be disposed in an upper area of the lower wall 100*b* to supply cold air to a lower region of the freezer compartment 52.

The grill fan lower region outlet holes 112*a* and 112*b* may include a first grill fan lower region outlet hole 112*a* and a pair of second grill fan lower region outlet holes 112*b* disposed on both sides of the first grill fan lower region outlet hole 121*a*.

The lower wall 100*b* may have an inclined surface that gets closer to the center direction downward.

A water discharge hole 129 may be formed in a central region of the lower wall 100*b*. The condensate or defrost water generated from the inner components of the grill fan assembly may be discharged through the water discharge hole 129.

The grill fan assembly 100 according to the present disclosure may include a plurality of cold air flow path guides 191, 192, 193 and 194 configured to guide the flow path of cold air flowing in the grill fan assembly 100.

The cold air flow path guides 191, 192, 193 and 194 may be projected toward the rear surface of the grill fan 110 in an island shape having a predetermined pattern to guide the cold air flow path.

A first cold air flow path guide 191 may be disposed between the freezing fan module 160 and the ice-making fan module 170.

One lateral surface of the first cold air path guide 191 facing the ice-making fan module 170 may be curved to surround the ice-making fan module 170.

A third cold air flow path 163 may be formed in an upper area of the ice-making fan module 170 in a direction toward the ice-making chamber cold air outlet 172.

In other words, the third cold air flow path 163 may be provided between the ice-making fan module 170 and the ice-making chamber cold air outlet 172.

The cold air blown by the ice-making fan module 170 may be smoothly supplied to the ice-making chamber 22 through the third cold air flow path 163 due to the curved shape of the first cold air flow path guide 191.

An ice-making chamber cold air outlet 172 of the grail assembly 100 may be formed in an upper end of the grill assembly 100, and may be in communication with an ice-making chamber cold air guide duct 610 configured to facilitate communication between the ice-making chamber cold air supply duct 600 and the grill fan assembly 100.

The second cold air flow path guide 912 may be disposed between the first cold air flow path guide 191 and the freezing fan module 160.

The second cold air flow path guide 192 may be spaced apart from the first cold air flow path guide 191 and the freezing fan module 160.

A second cold air flow path 162 may be formed between the first cold air flow path guide 191 and the second cold air flow path guide 192.

One lateral surface of the second cold air flow path guide 192 facing the first cold air flow path guide 191 may be curved to guide a cold air flow direction of the second cold air flow path 162.

Accordingly, an upper end of the second cold air flow path 162 may be toward the grill fan upper region outlet hole 111 and a lower end of the second cold air flow path 162 may be toward a lower area of the ice-making fan module 170.

The cold air blown by the ice-making fan module 170 may be supplied to the grill fan upper region outlet hole 111 through the second cold air flow path 162.

In addition, the cold air blown by the freezing fan module 160 may flow along a lower periphery 170*a* of the ice-making fan module 170 through the second cold air flow path 162.

The cold air flowing along the lower periphery 170*a* of the ice-making fan module 170 may be supplied to the ice-making chamber 22 through the third cold air flow path 163.

The first cold air flow path guide 191 and the second cold air flow path guide 192 may be spaced apart from the upper wall 100*a*.

Specifically, an upper end of the first cold air flow path guide 191 and an upper end of the upper lateral wall 100*a* may be spaced a preset distance apart from the upper wall 100*a*.

Since the first cold air flow path guide 191 and the second cold air flow path guide 192 may form a space with the upper wall 100*a*, the first cold air flow path 161 may be formed between the first cold air flow path guide 191 and the upper wall 100*a*.

The first cold air flow path 161 may also pass through the space formed between the second cold air flow path guide 192 and the upper wall 100*a* to be continued to the freezing fan module 160.

Accordingly, the cold air blown by the freezing fan module 160 may be supplied to the ice-making chamber cold air outlet 172 through the first cold air flow path 161.

An upper end of the second cold air flow path guide 192 may be positioned lower than an upper end of the freezing fan module 160 and an upper end of the first cold air flow path guide 191.

The cold air blown by the freezing fan module 160 may smoothly flow to the first cold air flow path 161, without cold air flow interference.

An upper end of the first cold air flow path guide 191 may be positioned higher than an upper end of the ice-making fan module 170.

In other words, the first cold air flow path 161 may be positioned higher than the ice-making fan module 170.

Accordingly, interference of the cold air flow passing through the first cold air flow path 161 formed in the space between the first cold air flow path guide 191 and the upper wall 100*a* may be reduced.

The first cold air flow path 161 and the third cold air flow 163 may be directly in communication with each other, to form a cold air flow path in the same direction toward the ice-making chamber cold air outlet 172.

The first cold air flow path guide 191 and the second cold air flow path guide 192 may be spaced apart from one lateral surface 100*c*.

The ice-making fan module 170 may be disposed between the first cold air flow path guide 191 and the lateral surface 100*c*.

The first cold air flow path guide 191 may have a shape surround some lateral surfaces of the ice-making fan module 170, not a lower periphery 170*a* of the ice-making fan module 170, so that the cold air blown by the ice-making fan module 170 may flow into the space between the first cold air flow path guide 191 and the lateral surface 100*c*.

Accordingly, a fourth cold air flow path 164 may be formed in the space formed between the second cold air flow path guide 192 and the lateral surface 100*c*.

The cold air blown to the lower area of the ice-making fan module 170 may flow into the grill fan lower region outlet hole 112*a* and 112*b* provided in the lower region of the grill fan assembly 100 through the fourth cold air flow path 164, to be supplied to the freezer compartment 52.

The third cold air flow path guide 193 may be disposed between the second cold air flow path guide 192 and the grill fan lower region outlet hole 112*a* and 112*b*.

The third cold air flow path guide 193 may be spaced apart from the second cold air flow path guide 192, the lateral wall 100*c* and the grill fan lower region outlet hole 112*a* and 112*b*.

The third cold air flow path guide 193 may be formed by branching the flow direction of the cold air flowing through the fourth cold air flow path 164.

Accordingly, a fifth cold air flow 165 may be formed between the second cold air flow path guide 192 and the third cold air flow path guide 193. A sixth cold air flow path 166 may be formed between the third cold air flow path guide 193 and the lateral wall 100*c*.

The fifth cold air flow path 165 may be configured to guide the cold air toward the center of the grill fan assembly 100. The sixth cold air flow path 166 may be configured to guide the cold air toward the grill fan lower region outlet hole.

A seventh cold air flow path 167 may be formed between the freezing fan module 160 and the grill fan lower region outlet hole 112*a* and 112*b*.

The cold air blown by the freezing fan module 160 may be discharged to the grill fan upper region outlet hole 111 and supplied to the upper region of the freezer compartment 52.

The cold air blown by the freezing fan module 160 may pass through the seventh cold air flow path 167 to be discharged to the grill fan lower region outlet hole 112*a* and 112*b* and supplied to the lower region of the freezer compartment 52.

One lateral surface of the second cold air flow path guide 192 facing the freezing fan module 160 may have a shape surrounding some area of the lateral surface of the freezing fan module 160.

A cold air flow path auxiliary rib 193*a* may be extended from one end of the lateral surface of the second cold air flow path guide 192 toward the lower area of the freezing fan module 160.

The cold air flow path auxiliary rib 193*a* may be formed in a shape surrounding some lower area of the freezing fan module 160.

The cold air flow path auxiliary rib 193*a* may be configured to properly distribute the flow rate of cold air blown by the freezing fan module 160 to the upper and lower regions of the freezer compartment 52 and to secure the flow rate to cold air to the refrigerator compartment 51.

The fourth cold air flow guide 194 may be disposed between the freezing fan module 160 and the grill fan lower region outlet hole 112*a* and 112*b*.

Accordingly, an eighth cold air flow path 168 may be formed between the freezing fan module 160 and the fourth cold air flow path guide 194. A ninth cold air flow path 169 may be formed between the fourth cold air flow path guide 194 and the other lateral surface 100*d*.

The flow path opening/closing module 130 may be disposed on the other lateral surface of the freezing fan module 160.

The fourth cold air flow path guide 194 may be disposed adjacent to the flow path opening/closing module 130.

The eighth cold air flow path 168 formed by the fourth cold air flow path guide 194 may be directed toward the flow path opening/closing module 130. The ninth cold air flow path 169 may be directed toward the grill fan lower region outlet hole 112*a* and 112*b*.

Accordingly, the cold air blown by the freezing fan module 160 may be guided to the flow path opening/closing module 130 through the eighth cold air flow path 168 to be supplied to the refrigerator compartment 51 by the flow path opening/closing module 130.

When the flow path opening/closing module 130 is closed, the cold air flowing through the eighth cold air flow path 168 may flow downward through the ninth flow path 169 and may be discharged to the grill fan lower region outlet holes 112*a* and 112*b* to be supplied to the freezer compartment 52.

Even when the flow path opening/closing module 130 is open, all of the cold air flowing through the eighth cold air flow path 168 may not be supplied to the refrigerator compartment 51 but some cold air could return to the ninth cold air flow path 169 due to a pressure difference.

The flow of the cold air flowing through the flow paths described above may be variable based on whether the freezing fan module 160 and the ice-making fan module 170 are operating.

Accordingly, hereinafter, the cold air flow based on the operation or non-operation of the freezing fan module 160 and the ice-making fan module 170 will be described in detail.

The cold air flow according to the present disclosure means a main path through which cold air flows. Cold air can flow through other paths.

Therefore, it should not be construed as limiting that cold air does not flow through a part other than the cold air paths described above in the present disclosure.

FIG. 8 is a rear view of a grill fan, showing a cold air flow path when the freezing fan module 160 and the ice-making fan module 170 are operated at the same time.

In this instance, the cold air blown by the freezing fan module 160 may flow into the first cold air flow path 161, the second cold air flow path 162, the seventh cold air flow path 167, the eighth cold air flow path 168 and the ninth cold air flow path 169.

The cold air blown by the ice-making fan module 170 may flow into the second cold air flow path 162, the third cold air flow path 163, the fourth cold air flow path 164, the fifth cold air flow path 165 and the sixth cold air flow path 166.

The first cold air flow path 161 may be in direct communication with the third cold air flow path 163 to be directed toward the ice-making chamber cold air outlet 172. Accordingly, when the freezing fan module 160 and the ice-making fan module 170 are operating at the same time, the cold air passing through the first cold air flow path 161 and the cold air passing through the third cold air flow path 163 may be mixed to be supplied to the ice-making chamber 22.

Specifically, since not only the ice-making fan module 170 but also the freezing fan module 160 may supply cold air to the ice-making chamber 22, sufficient cold air may be supplied to the ice-making chamber 22 even when the ice-making chamber 22 and the grill fan assembly 100 are far distant from each other.

The cold air blown by the ice-making fan module 170 may flow through the fourth cold air flow into the grill fan lower region outlet holes 112*a* and 112*b* through the fourth cold air flow path 164 and the sixth cold air flow 166 to be supplied to the freezer compartment 52.

Accordingly, since not only the freezing fan module 160 but also the ice-making fan module 170 may supply cold air to the freezer compartment 52, sufficient cold air may be supplied to the freezer compartment 52 even though the cold air generated by one evaporator 101 is supplied to the refrigerator compartment 51, the freezer compartment 52 and the ice-making chamber 22.

When the freezing fan module 160 and the ice-making fan module 170 are operating at the same time, the cold air blown by the ice-making fan module 170 and the cold air blown by the ice-making fan module 170 may pass through the second cold air flow path 162 in the opposite directions, respectively. Due to this structure, cold air might be stagnant in the second cold air path 162.

FIG. 9 is a rear view of a grill fan, showing a cold air flow path when an ice-making fan is not operated.

In this instance, the cold air blown by the freezing fan module 160 may flow through the first cold air flow path 161, the second cold air flow path 162, the seventh cold air flow path 167, the eighth cold air flow path 168 and the ninth cold air flow path 169.

When the ice-making fan 170 is not operating, a negative pressure could be generated in the grill fan assembly 100.

Accordingly, humid cold air in the refrigerator compartment 51 may flow backward to the grill fan assembly 100 through the ice-making chamber cold air outlet 172.

If such humid cold air flows backward to the grill fan assembly 100, the backward flowing cold air might be conceived in the ice-making fan module 170 in focus.

The cold air conceived on the ice-making fan module 170 might be frozen by the evaporator 101 so that the ice-making fan of the ice-making fan module 170 could be frozen not to operate.

However, according to the present disclosure, when the ice-making fan module 170 is not operating, the cold air blown by the freezing fan module 160 may flow to the cold air outlet 172 through the first cold air flow path 161. Accordingly, the inlet of the cold air flowing backward to the ice-making fan module 170 may be blocked as much as possible.

If frost occurs on the ice-making fan module 170, frost could be mainly conceived on a lower end of the ice-making fan module 170.

Accordingly, since the cold air blown by the freezing fan module 160 may pass through the second cold air flow path 162 and then a lower periphery 170*a* of the ice-making fan module 170, the cold air flow capable of blocking humid cold air from being conceived on the lower end of the ice-making fan module 170 may be made.

That is, the present disclosure may allow the cold air flowing through the first cold air flow path 161 to primarily block the humid cold air from flowing backward. Hence, the present disclosure may allow the cold air after passing through the second cold air flow path 162 to pass through the lower periphery 170*a* of the ice-making fan module 170, only to secondarily block the humid cold air from being conceived on the lower end of the ice-making fan module 170. Accordingly, the present disclosure may reduce the freezing of the ice-making fan module 170 as much as possible.

FIG. 10 is a rear view of a grill fan, showing a cold air flow path when a freezing fan module is not operated while an ice-making fan module is operated.

In this instance, the cold air blown by the ice-making fan module 170 may flow through the second cold air flow path 162, the third cold air flow path 163, the fourth cold air flow path 164, the fifth cold air flow path 165 and the sixth cold air flow path 166.

When the ice-making fan 170 is not operating, a negative pressure could be generated in the grill fan assembly 100 and cold air could flow backward to the grill fan assembly 100 from the freezer compartment 52.

The cold air flowing backward from the freezer compartment 52 may flow into the grill fan assembly 100 through the grill fan upper region outlet hole 111 and the grill fan lower region outlet holes 112*a* and 112*b*.

Since even the cold air flowing backward from the freezer compartment 52 is relatively humid, the cold air flowing backward might free the inner components of the grill fan assembly 100 such as the freezing fan module 160 or the flow path opening/closing dampers 140 and 150.

However, in the present disclosure, the cold air blown by the ice-making fan module 170 may be discharged to the grill fan upper region outlet hole 111 through the second cold air flow path 162, and to the grill fan lower region outlet holes 112*a* and 112*b* through the fourth cold air flow path 164 and the sixth cold air flow path 166, so the inside of the grill fan assembly 100 may have a positive pressure.

Accordingly, even when the freezing fan module 160 is not operating, the inlet of the cold air flowing backward to the grill fan assembly 100 from the freezing compartment 52 may be blocked as much as possible, thereby greatly reducing the freezing of the inner components provided in the grill fan assembly 100.

One objective of the present disclosure is to provide a refrigerator that may reduce freezing of an ice-making fan module due to cold air flowing backward, when an ice-making fan module is not operated.

A further objective of the present disclosure is to provide a refrigerator that may reduce freezing of inner components provided in a grill fan assembly due to cold air flowing backward, when a freezing fan module is not operated.

A still further object of the present disclosure is to provide a refrigerator that may supply a sufficient amount of cold air to a freezer compartment.

A still further object of the present disclosure is to provide a refrigerator that may supply a sufficient amount of cold air to an ice-making chamber even when an ice-making chamber is far distant from a grill fan assembly.

Aspects according to the present disclosure are not limited to the above ones, and other aspects and advantages that are not mentioned above can be clearly understood from the following description and can be more clearly understood from the embodiments set forth herein.

A refrigerator according to an embodiment of the present disclosure is characterized in that a grill fan assembly includes a first cold air flow guide disposed between a freezing fan module and an ice-making fan module; and a second cold air flow path guide disposed between the freezing fan module and the first cold air flow path guide, and that the first cold air flow path guide and the second cold air flow path guide are spaced apart from an upper wall of the grill fan assembly.

Specifically, the cold air flow path may be formed between the first cold air flow path guide and the upper wall of the grill fan assembly by spacing the first cold air flow path guide and the second cold air flow path guide apart from the upper wall of the grill fan assembly. Accordingly, even when an ice-making fan module is not operating, the cold air blown by the freezing fan module may be blocked from flowing backward to the ice-making fan module.

The refrigerator according to an embodiment of the present disclosure may include an evaporator configured to generate cold air; and a grill fan assembly configured to blown the cold air generated by the evaporator to a freezer compartment and an ice-making chamber. The grill fan assembly may include a freezing fan module; an ice-making fan module disposed in a predetermined area of the freezing fan module; a first cold air flow path guide disposed between the freezing fan module and the ice-making fan module; and a second cold air flow path guide disposed between the freezing fan module and the first cold air flow path guide, and the first cold air flow path guide and the second cold air flow path guide may be spaced apart from an upper wall of the grill fan assembly.

A first cold air flow path may be provided between the first cold air flow path guide and the upper wall of the grill fan assembly, and a second cold air flow path may be provided between the first cold air flow path guide and the second cold air flow path guide.

The first cold air flow path may be disposed higher than the ice-making fan module.

An ice-making chamber cold air outlet may be provided on one upper end of the grill fan assembly and configured to supply cold air to the ice-making chamber, and the cold air blown by the freezing fan may be supplied to the ice-making chamber cold air outlet through the first cold air flow path.

A third cold air flow path may be provided between the ice-making fan module and the ice-making chamber cold air outlet, and the cold air blown by the ice-making fan module may be supplied to the ice-making chamber cold air outlet through the third cold air flow path. The first cold air flow path and the third cold air flow path may be in direct communication with each other.

A grill fan upper region outlet hole may be provided in an upper area of the grill fan assembly, and the second cold air flow path may be formed toward the grill fan upper region outlet hole.

The cold air blown by the ice-making fan module may be supplied to the grill fan upper region outlet hole through the second cold air flow path.

The first cold air flow path guide and the second cold air flow path guide may be spaced apart from one lateral wall of the grill fan assembly, and the ice-making fan module may be disposed between the first cold air flow path guide and the lateral wall. A fourth cold air flow path may be provided between the second cold air flow path guide and the lateral wall.

The freezing fan module may pass through the second cold air flow path and then a lower periphery of the ice-making fan module.

A grill fan lower region outlet hole may be provided in a lower region of the grill fan assembly, and the cold air blown by the ice-making fan module may be supplied to the grill fan lower region outlet hole through the fourth cold air flow path.

A third cold air flow path guide may be disposed between the second cold air flow path guide and the grill fan lower region outlet hole, and a fifth cold air flow path may be disposed between the second cold air flow path guide and the third cold air flow path guide. A sixth cold air flow path may be disposed between the third cold air flow path guide and the lateral wall.

The fifth cold air flow path may be toward a center of the grill fan assembly, and the sixth cold air flow path may be toward the grill fan lower region outlet hole.

The grill fan lower region outlet hole may be disposed in a lower region of the freezing fan module, and a seventh cold air flow path may be disposed between the freezing fan module and the grill fan lower region outlet hole.

A fourth cold air flow path guide may be disposed between the freezing fan module and the grill fan lower region outlet hole, and an eighth cold air flow path may be provided between the freezing fan module and the fourth cold air flow path guide. A ninth cold air flow path may be provided between the fourth cold air flow path guide and the other lateral wall of the grill fan assembly.

A flow path opening/closing module may be disposed on the other area of the freezing fan module, and the eighth cold air flow path may be formed toward the flow path opening/closing module, and the ninth cold air flow path may be formed toward the grill fan lower region outlet hole.

In the refrigerator according to the present disclosure, the first cold air flow path through which the cold air blown by the freezing fan module may flow toward the ice-making chamber cold air outlet may be formed. Accordingly, the refrigerator may block the inlet of the cold air flowing backward to the ice-making fan module as much as possible even when the freezing fan module is not operating.

In addition, in the refrigerator according to the present disclosure, the second cold air flow path through which the cold air blown by the ice-making fan module flows toward the grill fan upper region outlet hole may be formed, accordingly, the inside of the grill fan assembly may have a positive pressure due to the cold air blown by the ice-making fan module, so that the refrigerator may block the inlet of the cold air flowing backward to the grill fan assembly as much as possible.

In addition, the fourth cold air flow path through which the cold air blown by the ice-making fan module flows toward the inside of the grill fan assembly and the lower region outlet hole may be formed. Accordingly, not only the freezing fan module but also the ice-making fan module may supply the cold air to the freezer compartment, thereby supplying sufficient cold air to the freezer compartment.

In addition, the first cold air flow path through which the cold air blown by the freezing fan module flows toward the ice-making chamber cold air outlet may be in direct communication with the third cold air flow path through which the cold air blown by the ice-making fan module flows toward the ice-making chamber cold air outlet. Accordingly, accordingly, not only the freezing fan module but also the ice-making fan module may supply the cold air to the ice-making chamber, thereby supplying sufficient cold air to the ice-making chamber.

Specific effects are described along with the above-described effects in the section of Detailed Description.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

an evaporator configured to provide cold air; and a grill fan assembly configured to blow the cold air from the evaporator to a freezer compartment and an ice-making chamber, wherein the grill fan assembly includes:

an upper wall:

a freezing fan;

an ice-making fan disposed at a side of the freezing fan;

a first flow path guide disposed between the freezing fan and the ice-making fan, and disposed apart from the upper wall; and a second flow path guide disposed between the freezing fan and the first flow path guide, and disposed apart from the upper wall, wherein the grill fan assembly is configured to provide:

a first cold air flow path between the first flow path guide and the upper wall; and a second cold air flow path between the first flow path guide and the second flow path guide, and wherein cold air blown from the freezing fan flows to the first cold air flow path passing above the ice-making fan.

2. The refrigerator of claim 1, wherein the first cold air flow path is located higher than the ice-making fan.

3. The refrigerator of claim 1, wherein the grill fan assembly includes an ice-making chamber outlet at an upper end of the grill fan assembly, and is configured to supply the cold air to the ice-making chamber, and wherein the cold air blown by the freezing fan is supplied through the first cold air flow path to the ice-making chamber outlet.

4. The refrigerator of claim 3, wherein the grill fan assembly is configured to provide:

a third cold air flow path between the ice-making fan and the ice-making chamber outlet, and wherein the cold air blown by the ice-making fan is supplied through the third cold air flow path to the ice-making chamber outlet, and the first cold air flow path and the third cold air flow path are in direct communication with each other.

5. The refrigerator of claim 1, wherein the grill fan assembly includes a grill fan outlet hole at an upper area of the grill fan assembly, and wherein the grill fan assembly is configured to provide the second cold air flow path toward the grill fan outlet hole.

6. The refrigerator of claim 1, wherein the grill fan assembly is configured to provide the cold air blown by the ice-making fan through the second cold air flow path to the grill fan outlet hole.

7. The refrigerator of claim 4, wherein the first flow path guide and the second flow path guide are spaced apart from a first lateral wall of the grill fan assembly wherein the ice-making fan is disposed between the first flow path guide and the first lateral wall, and wherein the grill fan assembly is configured to provide a fourth cold air flow path between the second flow path guide and the first lateral wall.

8. The refrigerator of claim 7, wherein the grill fan assembly is configured to provide the cold air blown by the freezing fan to pass through the second cold air flow path and then flow toward a lower part of the ice-making fan.

9. The refrigerator of claim 7, wherein the grill fan assembly includes a grill fan outlet hole at a lower region of the grill fan assembly, and wherein the grill fan assembly is configured to provide the cold air blown by the ice-making fan through the fourth cold air flow path to the grill fan outlet hole.

10. The refrigerator of claim 9, wherein a third flow path guide is disposed between the second flow path guide and the grill fan outlet hole, and wherein the grill fan assembly is configured to provide:

a fifth cold air flow path between the second flow path guide and the third flow path guide; and a sixth cold air flow path between the third flow path guide and the first lateral wall.

11. The refrigerator of claim 10, wherein the grill fan assembly is configured to provide:

the fifth cold air flow path toward a center of the grill fan assembly; and the sixth cold air flow path toward the grill fan outlet hole.

12. The refrigerator of claim 9, wherein the grill fan outlet hole is disposed in a lower region of the freezing fan, and wherein the grill fan assembly is configured to provide a seventh cold air flow path between the freezing fan and the grill fan outlet hole.

13. The refrigerator of claim 12, wherein a fourth flow path guide is disposed between the freezing fan and the grill fan outlet hole, and wherein the grill fan assembly is configured to provide:

an eighth cold air flow path between the freezing fan and the fourth flow path guide; and a ninth cold air flow path between the fourth flow path guide and a second lateral wall of the grill fan assembly.

14. The refrigerator of claim 13, wherein the grill fan assembly includes a flow path opening/closing module, and wherein the grill fan assembly is configured to provide:

the eighth cold air flow path toward the flow path opening/closing module; and the ninth cold air flow path toward the grill fan outlet hole.

* * * * *